United States Patent [19]

Schiffer

[11] 4,206,618

[45] Jun. 10, 1980

[54] APPARATUS FOR CONTINUOUS FULL-WIDTH WASHING OF A TEXTILE CLOTH LAYER

[75] Inventor: Günter Schiffer, Krefeld, Fed. Rep. of Germany

[73] Assignee: Kleinewefers GmbH, Krefeld, Fed. Rep. of Germany

[21] Appl. No.: 13,805

[22] Filed: Feb. 21, 1979

[30] Foreign Application Priority Data

Feb. 21, 1978 [DE] Fed. Rep. of Germany ..... 2807313

[51] Int. Cl.[2] ..... D06B 1/02; D06B 13/00

[52] U.S. Cl. ..... 68/3SS; 68/205 R

[58] Field of Search ..... 68/3 SS, 205 R, 181 R; 134/9, 15, 64 R, 64 P, 122 R, 122 P

[56] References Cited

U.S. PATENT DOCUMENTS 3,470,571 10/1969 Hrboticky ..... 68/205 R X 3,922,738 12/1975 Holm ..... 68/3 SS X 3,950,802 4/1976 Schiffer et al. ..... 68/181 R X

FOREIGN PATENT DOCUMENTS 2811515 9/1978 Fed. Rep. of Germany ..... 68/181 R

*Primary Examiner*—Philip R. Coe

*Attorney, Agent, or Firm*—Becker & Becker, Inc.

[57] ABSTRACT

An apparatus for continuous full-width washing of a textile cloth layer, which is guided horizontally or nearly horizontally between reversing rollers arranged in two vertical rows so as to form horizontal cloth layer sections between respective rollers of the two rows of rollers. The upper side of a given horizontal cloth layer section is supplied with a washing liquor film. Devices are arranged between the vertical rows of rollers for imparting vertical or nearly vertical vibrations to the respective horizontal cloth layer sections.

7 Claims, 2 Drawing Figures

APPARATUS FOR CONTINUOUS FULL-WIDTH WASHING OF A TEXTILE CLOTH LAYER

The present invention relates to an apparatus for continuous full-width washing of a textile cloth layer or width of fabric which is guided horizontally or nearly horizontally between reversing rollers arranged in two vertical rows, the upper side of a given horizontal section of the cloth layer being provided with a washing liquor film.

Such an apparatus is known. The washing action of this heretofore known apparatus can, among other things, be influenced by the length of time allowed for the applied liquor film to diffuse into the cloth layer. This rate of diffusion can be influenced as a function of the fabric structure, that is, essentially the density of the fabric, by the speed of the cloth layer.

It is an object of the present invention to improve the apparatus of the above mentioned general type in such a way that a further possibility of influencing or controlling the action of the applied liquor film on the cloth layer is obtained. In this connection, a further parameter for affecting the washing process should be provided, which further parameter is independent of the speed of the cloth layer as a parameter of the washing process. This further influence should be made possible with means which are structurally inexpensive as well as simple with regard to manufacturing process.

Figure 1:
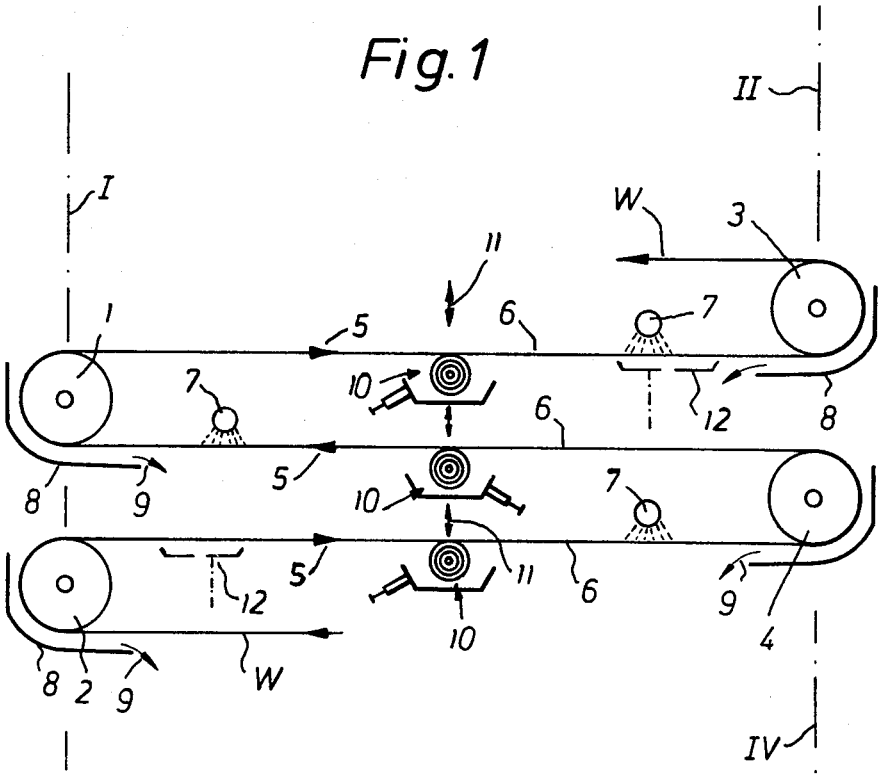
Figure 2:
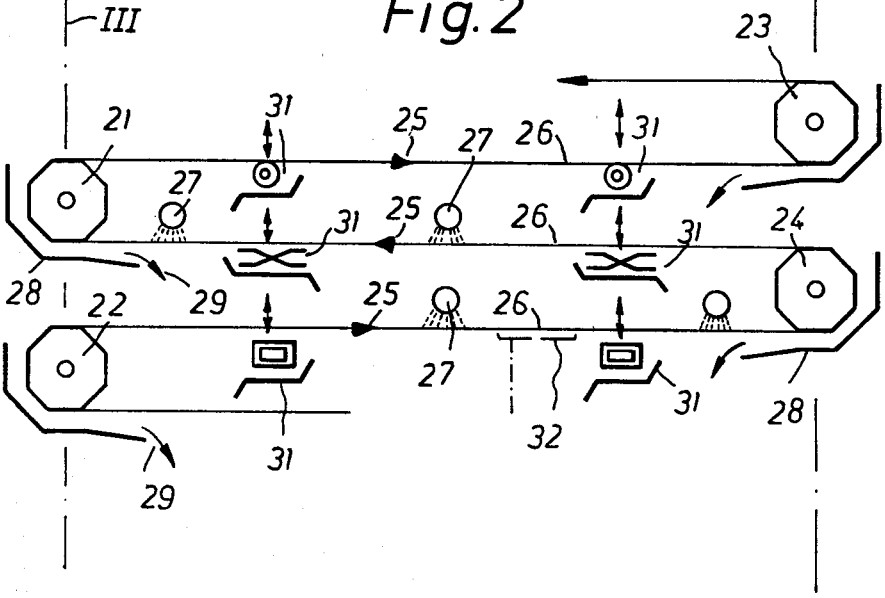

This object, and other objects and advantages of the present invention, will appear more clearly from the following specification in connection with the accompanying drawing, in which:

FIG. 1 diagrammatically shows an apparatus having reversing rollers with round cross sections and having vibrating devices arranged between successive reversing rollers in the direction of travel of the cloth layer; and FIG. 2 diagrammatically shows an apparatus having reversing devices with a multi-angled cross section and having a plurality of different vibrating devices between successive reversing devices.

The apparatus of the present invention is characterized primarily in that between the vertical rows of rollers devices are arranged which impart vertical or nearly vertical vibrations to the horizontal or nearly horizontal cloth layer sections.

The washing liquor film is preferably applied by a plurality of nozzles, sprayers, or feed plates which are consecutively arranged in the direction of movement of the cloth layer and extend over the width of the cloth layer. Likewise, a plurality of vibrating devices can be arranged consecutively at a distance from one another in the direction of movement of the cloth layer on a horizontal or nearly horizontal cloth layer section. The coordination of the nozzles or plates, which supply the washing liquor film, to the vibrating devices can be handled in such a way that successive devices apply different amounts of liquor, as well as that different vibrating conditions of the vibrating devices can be achieved. Thus, for example, the frequency and/or the amplitude and/or the phase relationship of the vibrating device or devices can be altered.

The vibrating device or devices are preferably arranged below the cloth layer section between two reversing rollers. In this connection, especially with a plurality of vibrating devices arranged below a cloth layer section between two reversing rollers, one or the other device can be lowered to such an extent that the vibrating cloth layer does not contact the lowered vibrating device, as a result of which the vibration width and height of the cloth layer section can additionally be influenced.

Pursuant to a further feature of the present invention, the washing liquor supply and the operation of the vibrating devices can be continuously controllable, for example by means of devices which measure the washing liquor which passes through the cloth layer. This means that if too little washing liquor enters or passes through the cloth layer, a correction of the washing liquor supply or the magnitude of the vibrations can be obtained.

Although it is known, in washing apparatuses, to provide vibrating elements for horizontal cloth layer sections, these elements must likewise impart vibrations to the liquor bath through which the cloth layer is passed. On the one hand, this requires a high consumption of energy, and on the other hand does not allow high diffusion action of the washing liquor to be obtained due to the equal phased and equi-directed vibrations of the liquor fluid with the cloth layer. According to the present invention, the principle of liquor film inertia is used, with little mass movement, to increase the amount of liquor film which enters or passes through the cloth layer, so that, during every upwardly directed lift or stroke of the cloth layer, the applied liquor film, due to its mass moment of inertia in addition to its gravitation, is pressed into the cloth layer and, as the case may be, liquor is forced out of the cloth layer.

Reversing rollers, to which vibrations are imparted, are also known in the technology of washing textile cloth layers. Such reversing rollers again require a high consumption of energy due to the large mass of the rollers which are to be moved. Moreover, vibrations having amplitudes and frequencies comparable to those of the vibrations obtainable with the apparatus of the present invention cannot be imparted to the heretofore known reversing rollers.

Spreader or stretcher rods intended for full-width washing units and located below the cloth layer are also known, with washing liquor being applied to these rods. The purpose of these rods, in addition to stretching the cloth layer, is to also bring about a stripping off of liquor which has passed through the cloth layer. With this heretofore known rod arrangement, a utilization of the mass moment of inertia of the applied liquor film by vibrations of the cloth layer for the purpose of bringing about a quicker and more intensive entry of liquor into the cloth layer is neither intended nor possible. Contact rollers, upon which the straight horizontal cloth layer sections between two reversing rollers can be supported, are known. Due to their adjustability as to height, these contact rollers are merely intended for eliminating the slack or sag of the horizontal cloth layer section between two reversing rollers.

Referring now to the drawing in detail, FIG. 1 shows reversing rollers 1, 2, 3, 4 arranged in two vertical rows I, II which are parallel to one another. The textile cloth layer W is guided over the reversing rollers in the direction of the arrows 5. In so doing, the two rows I, II are staggered relative to one another with regard to height by the diameter of the rollers, so that, as shown in FIG. 1, horizontal cloth layer sections 6 are formed between successive rollers in the direction of movement of the cloth layer.

Sprayers 7 are arranged above these horizontal cloth layer sections 6. By means of these sprayers 7, liquor or liquid mixture is placed upon the upper side of the cloth layer sections 6 in any desired quantity. The sprayers 7 are furnished in conformity with requirements. The quantity supplied by a respective sprayer 7 can differ from adjacent sprayers.

In addition to the amount of washing liquor, which is placed on the upper side of the cloth layer sections 6 by the sprayers 7, collector or trap and guide or deflector plates 8 can be arranged in a known manner below the reversing rollers 1–4. Washing liquor which is pressed through by the cloth layer is trapped by the collecting and deflecting plates 8 and is conveyed in the direction of the arrow 9 to the next lower cloth layer section 6. A portion of the washing liquor passes over the plates 8; another portion passes from the sprayer 7 onto the cloth layer sections 6.

In the embodiment shown in FIG. 1, vibrating devices 10 are arranged below the cloth layer section 6 in the middle between successive reversing rollers. By means of the vibrating devices 10, the cloth layer sections 6 receive vibrations which are essentially directed in the direction of the arrows 11, that is, a vibration perpendicular to the longitudinal direction of the cloth layer section. The amplitude as well as the frequency of these vibrating devices are variable.

In the embodiment of FIG. 2, angular revering device 21, 22, 23, 24 are provided in place of the reversing rollers 1–4 which have a round cross section. The reversing devices 21 24 are again arranged in two vertical rows III and IV which are parallel to one another and are staggered in height relative to one another, so that between these rows the cloth layer which passes in the direction of the arrows 25 again forms horizontal sections 26 upon which washing liquor can be placed by means of sprayers 27. Reversing plates 28 can also be provided as above. By means of these plates 28, washing liquor which comes from the cloth layer or is sprayed off therefrom is conveyed to the reversing devices in the direction of the arrows 29 upon the next lowest cloth layer section 26.

The embodiment shown in FIG. 2 also has vibrating devices 31 below the cloth layer sections 6. These vibrating devices 31 can be of different types. In contrast to the embodiment of FIG. 1, a plurality (two in FIG. 2) of vibrating devices 31 are arranged below each cloth layer section 26 and can have different frequencies, amplitudes and phase relationships relative to one another.

A measuring device (12 in FIG. 1, and 32 in FIG. 2) which controls the supply of washing liquor through the nozzles 7 and 27 as well as the individual amplitudes, etc., of the vibrating devices 10, 31, can respectively be provided below the straight cloth layer sections 6 and 26.

The vibrating devices 10, 31 preferably operate at a frequency of 2000–3000 Hz at an advantageous amplitude of 0.5–3 mm of the vibrating device and thereby also the cloth layer. These values are essentially governed by the spacing of the successive reversing devices 1–4 or 21–24, the type of material of the cloth layer, the amount of washing liquor of a given viscosity which is supplied, and finally, the tensioning of the cloth layer between successive reversing devices.

If a plurality of vibrating devices are provided below a straight cloth layer section, as illustrated in FIG. 2, one of the two vibrating devices can preferably be lowered to such an extent that selectively only one of the vibrating devices comes in contact with a cloth layer section 26 without the second vibrating device of the same section contacting the cloth layer 26.

The present invention is, of course, in no way restricted to the specific disclosure of the specification and drawing, but also encompasses any modification within the scope of the appended claims.

What I claim is:

1. An apparatus for continuous full-width washing of a textile cloth layer, which apparatus comprises in combination:

two vertical rows of reversing devices, especially rollers, said rows being spaced from one another and said reversing devices being arranged in such a way that when a cloth layer is guided substantially horizontally from a reversing device of one row, to a reversing device of the other row, back to a reversing device of the first row, and so on, substantially horizontal internally-tensioned cloth layer sections are formed extending essentially unsupported between respective reversing devices of said two vertical rows of reversing devices;

means for supplying the upper side of a given substantially horizontal cloth layer section with a washing liquor film; and vibrating devices arranged between said vertical rows of reversing devices for imparting substantially vertical vibrations directly to the respective substantially horizontal cloth layer sections.

2. An apparatus in combination according to claim 1, in which said means for supplying a washing liquor film includes sprayers and feed plates consecutively arranged in the direction of movement of a cloth layer and extending over the width of a cloth layer.

3. An apparatus in combination according to claim 1, which includes a plurality of said vibrating devices arranged consecutively at a distance from one another in the direction of movement of a cloth layer and associated with respective substantially horizontal cloth layer sections.

4. An apparatus in combination according to claim 1, in which the parameters, including frequency, amplitude, and phase relationship, of said vibrating devices are variable.

5. An apparatus in combination according to claim 1, in which said vibrating devices are arranged below pertaining cloth layer sections between two reversing devices.

6. An apparatus in combination according to claim 5, which includes means for continuously controlling said vibrating devices, said means measuring washing liquor which passes through a cloth layer.

7. An apparatus in combination according to claim 1, in which said vibrating devices are adapted to impart to a pertaining substantially horizontal cloth layer section substantially vertical vibrations of 2000–3000 Hz and 0.5–3 mm amplitude.

* * * * *